US005152886A

United States Patent [19]

Paris-Marcano

[11] Patent Number: 5,152,886

[45] Date of Patent: Oct. 6, 1992

[54] METHOD FOR IMPROVING HEAVY CRUDE OILS BY REDUCING THE ASPHALTENE CONTENT OF CRUDE OILS AND OIL-CONTAINING TAR SANDS

[75] Inventor: Lucinda C. Paris-Marcano, Maracaibo, Venezuela

[73] Assignee: Laboratorios Paris, C.A., Maracibo, Venezuela

[21] Appl. No.: 606,178

[22] Filed: Oct. 31, 1990

[51] Int. Cl.[5] ..... C10G 17/00

[52] U.S. Cl. ..... 208/390; 208/265; 208/281; 208/282; 252/8.553

[58] Field of Search ..... 208/265, 390, 281, 282; 252/8.553

[56] References Cited

U.S. PATENT DOCUMENTS 4,359,391 11/1982 Salathiel et al. ..... 252/8.553

4,675,120 6/1987 Martucci ..... 208/46

*Primary Examiner*—Paul Lieberman

*Assistant Examiner*—Mary DiNunzio

*Attorney, Agent, or Firm*—Fleit, Jacobson, Cohn, Price, Holman & Stern

[57] ABSTRACT

A process for reducing asphaltene content of crude oil and oil-containing materials to improve rheological properties of crude oils enhancing the water-extractabilities of sulphur and metals contained in them. The process employs the cold cracking effect of a binary acid solution containing, preferably, hydrochloric acid and oleic acid. The process is particularly applicable to the exploitation of heavy and ultra-heavy oil deposits, to oil recovery from oil-containing tar sand, shale or clay and to the cleaning of oil tanks, garments and clogged oil-pipelines.

16 Claims, No Drawings

METHOD FOR IMPROVING HEAVY CRUDE OILS BY REDUCING THE ASPHALTENE CONTENT OF CRUDE OILS AND OIL-CONTAINING TAR SANDS

BACKGROUND OF THE INVENTION

At present, the oil industry faces several technical incapacities to respond to the increasingly higher worldwide demands. One of the biggest shortcomings is the fact that practically all of the world oil resources are of a heavy or ultra heavy nature, wherein asphaltene and/or asphaltene-like macromolecules are present in large amounts. Other important oil sources are oil-containing tar sands, shales or clays which present a similar problem.

The high content of asphaltene, together with the presence of sulphur and metals, makes oil recovery difficult both by affecting the rheological properties of the material from the oil well or by increasing environmental pollution hazards. Without a doubt, the oil industry must solve these problems taking into account the nature of almost all the huge oil reserves so far unexploited, mainly in Venezuela.

Oil recovery from the above mentioned type of deposits is difficult and costly since the steps of recovering, transporting, and refining are inefficient, making their exploitation quite laborious and unattractive. Another fact adversely affecting this matter is the potential environmental pollution risks produced by the metals and the sulphur contained in such oil deposits. No method has been developed so far which allows the obtention of a saleable oil-product, from deposits having unfavorable rheological properties and chemical composition throughout the entire industrial process.

Heavy oil and ultra-heavy oil recovery is performed at present mainly by injection of pressurized and overheated water vapor and also by mixing the oil with lighter organic solvents. Inorganic acids, e.g., hydrochloric and sulfuric acids, have also been used to acidize wells to improve the flow of the oil from the earth matrix. All of these methods do facilitate the oil management, but only up to its cooling and/or solvent separation after which the rheological difficulties reappear. Even though in Venezuela the method of the oil emulsion has been successfully applied to the transportation of crude oil, its use is not fully recommended since the value of that oil as combustible is markedly reduced.

Recently, in U.S. Pat. No. 4,675,120, Martucci described a method of using a low pH mixture of acids wherein the availability of hydronium ions in the mixture itself remains highly controllable, while the mixture itself remains non-corrosive to metals and innocuous to skin and other organic materials. These mixtures include several acids using two strong acids and two weak acids, preferably hydrochloric acid, oxalic acid, phosphoric acid, and citric acid. This patent describes the use of such acid mixtures for acidizing wells surrounded by clay or silicate formation and/or surrounded by calcareous formation. One Example in this patent describes the use of oleic acid and a mixture of hydrochloric, phosphoric, oxalic and citric acids for the recovery of oil from oil-containing sands.

The method of the present invention relates to the recovery of oil, under appropriate forms, from heavy and ultra-heavy oil deposits and from oil-containing sands. The inventive method is based on the cracking properties, at room temperature and normal pressure over the asphaltene macromolecules present in the crude oil, of a cracking-active mixture containing an inorganic acid and a liquid fatty acid, preferably hydrochloric acid and oleic acid. The method can also easily be applied to oil recovery from oil-containing tar sands. The chemical reactions occurring between the acid mixture and the heavy oil material are not yet fully understood, but the fact is that an improvement of the rheological properties of crude oil is attained by this convenient process which also facilitates the cleaning of sulphur and metals from the crude oil. It has also been found that the inorganic acid-fatty acid treatment of crude oils reduces the water content of the crude oil, probably due to the consumption of water molecules as proton sources during the depolymerization processes occurring at the asphaltene level wherein carbon ion might be involved.

It has been found that a binary mixture of an inorganic acid component and a liquid fatty acid component, e.g., hydrochloric and oleic acids, both in the form of a solution and in the form of a suspension, works much better than the poly-acid mixtures proposed in U.S. Patent No. 4,675,120. This is probably related to the consumption of water produced during the depolymerization process conducted with the binary mixture, which does not occur when using poly-acid mixtures. Along with water consumption, molecular oxygen is released producing a clear bubbling as the gas evolves off the oil sample, while hydrogen is likely being incorporated to some double linkages naturally occurring in the unsaturated hydrocarbon chains of asphaltene compounds.

SUMMARY OF THE INVENTION

The process of the present invention makes possible the elimination of the highly polymerized hydrocarbon molecules, i.e., asphaltenes, which are responsible for the poor rheological properties of heavy and ultra-heavy crude oils. Lighter, shorter hydrocarbon chains, asphaltene-free, are thus formed and consequently the viscosity of the crude oil is reduced appreciably thereby facilitating the crude oil liquefaction. Sulfur and metal extractability by water from the crude oil is simultaneously attained.

In accordance with the preferred embodiments of the present invention, an inorganic acid component is mixed with a liquid fatty acid component in the presence of a light organic solvent such as kerosene, optionally in the presence of a suitable emulsifying agent. Preferably, the inorganic acid is hydrochloric acid or sulfuric acid and the fatty acid is oleic acid, linoleic acid or linolenic acid. This cold-cracking solution or emulsion is mixed with the crude oil material to be treated and stirred at room temperature for about 1 to 5 minutes. Improvement of the rheological properties of the crude oil by diminishing its viscosity is attained. On the other hand, the cold cracking of asphaltene molecules releases metals and sulphur from the crude oil, which metals and sulphur can be further easily extracted by washing with water. The method of the invention is also suitable for treating sandy, shale and clay oil deposits, and for acidizing wells.

Once the reaction between the asphaltene-constituents of the heavy oil and the cracking solution occurs, both phases mix together forming a continuous phase without separating from each other and with no emulsion formation. This constitutes a great advantage of the method since no additional separation processes are required. Furthermore, the chemicals of the cracking solution incorporated in the oil will not affect further refining or distillation operations.

Accordingly, it is an object of the invention to provide a process for the elimination of asphaltene macromolecules, by means of cold cracking, from heavy and ultra-heavy crude oils and from oil-containing tar sands thereby improving their rheological properties and facilitating the subsequent removal of sulphur and metals.

Another object of the present invention is to provide a process for reclaiming crude oil from deep wells, thereby improving the efficiency of further distillation and/or purification processes.

Another object of the present invention is to provide a process for facilitating the removal of sulphur and metals from crude oils.

Another object of the present invention is to provide a process to open an oil well which has been sealed or clogged by asphaltene layers.

A further object of the present invention is to reduce the water content of crude oil thereby reducing the subsequent undesirable formation of emulsions.

A still further object of the present invention is to provide a method which can be practiced on oil tanks, pipelines and other oil-handling equipment to remove aged black products and oil residues.

DETAILED DESCRIPTION OF THE INVENTION

The method of the present invention comprises contacting an asphaltene-containing oil material with a cold cracking solution or emulsion (hereinafter "cold cracking composition"). The cold cracking composition contains two acid components, i.e., an inorganic acid component and a liquid fatty acid component; at least one light organic solvent; and, optionally, an emulsifying agent. Preferably, the inorganic acid is a strong acid such as hydrochloric acid or dilute sulfuric acid. Of these inorganic acids, hydrochloric acid is the most preferred inorganic acid.

The liquid fatty acid is preferably oleic acid, linolenic acid or linoleic acid, with oleic acid being most preferred.

The light organic solvent may be any suitable light organic solvent, such as kerosene, gasoline, diesel oil, benzin, or mixtures thereof. The most preferred light inorganic solvent is kerosene. Optionally a high molecular weight compound derived from petroleum such as gas oil, light lubricant oil, heavy lubricant oil or mixtures thereof can be used by mixing it with the organic solvent. The most preferred petroleum-derived high molecular weight compound is gas oil, a fraction of petroleum which distills at 150° C. to 250° C.

The optional emulsifying agent may be any suitable emulsifying agent, such as propylene glycol monolaurate (Atlas G-917), sorbitan monopalmitate (Span 40), Methocel 15, triethanolamine oleate, polyoxyethylene castor oil (Atlas G-1794), sodium laurylsulfate and Petrolite H-4455.

The weight ratio of the inorganic acid to the liquid fatty acid in the cold cracking composition is between 0.1:100 and 30:100. Preferably, the weight ratio of inorganic acid to fatty acid in the cold cracking composition is between 0.5:100 and 10:100.

The inorganic acid comprises between 0.1 and 15 percent by weight of the cold cracking composition, preferably between 0.5 and 6 percent. The fatty acid comprises between 20 and 80 percent of the cold cracking composition, preferably between 30 and 50 percent. The light organic solvent comprises between 30 and 80 percent by weight of the cold cracking composition, and preferably comprises between 35 and 60 percent by weight of the cold cracking composition. The petroleum-derived high molecular weight compound, e.g., gas oil, when used, comprises between 5 and 15 percent by weight of the cracking composition, preferably between 7 and 12 percent. If an optional emulsifying agent is included in the cold cracking composition, the emulsifying agent (or surfactant) may comprise up to 5 percent by weight of the cold cracking solution.

To prepare the cold cracking composition useful in the method of the present invention, the liquid fatty acid and light organic solvent and optional emulsifying agent and optional petroleum-derived high molecular weight compound are mixed, and then the inorganic acid is slowly added to the liquid fatty acid/light organic solvent mixture while stirring vigorously.

In accordance with the inventive method, the thus produced cold cracking composition is mixed with an asphaltene-containing oil material and the resulting mixture is vigorously stirred or otherwise agitated at a temperature between room temperature and 80° C. Preferably, this stirring or vigorous agitation of the mixture of the cracking solution and the asphaltene-containing oil material is carried out for about 1 to 10 minutes.

The method of the present invention is further illustrated by the following non-limiting examples.

EXAMPLE 1

250 ml of an asphaltene-containing Venezuelan crude oil was placed in each of eight 600 ml beakers. A solution of the present invention having the composition shown in Table I below was added to four of these beakers in a volume amount sufficient to provide a final concentration of 5, 10, 15 and 20% by weight of the cold cracking solution in the resultant mixture. To the other four beakers, a comparative solution described in U.S. Pat. No. 4,675,120 (oleic acid plus the solution of Table II) were added in a similar manner to produce final mixtures having a concentration of 5, 10, 15 and 20% by weight. The exact composition of this comparative solution was: 25 parts of oleic acid; 25 parts of a mixture composed by hydrochloric acid 7.5%, phosphoric acid 7.5% oxalic acid 3%, citric acid 3% and water 79% (expressed by weight); and 50 parts of kerosene. The resulting mixtures were stirred with a glass rod for 2 minutes. The compositions of the initial Venezuelan crude oil and of the mixtures after the inventive and comparative treatments are shown in Table II below.

TABLE I

| COMPOSTION BY WEIGHT OF COLD CRACKING SOLUTION | |
|---|---|
| Hydrochloric acid (HCl, d = 1.19 g/ml) | 1.0% |
| Oleic acid | 40.0% |
| Kerosene | 47.0% |
| Gas-oil | 10.0% |
| Emulsificant (Petrolite H-4455) | 2.0% |

Linolenic and linoleic acids have been also used instead of oleic acid, but with lower reduction on asphaltene contents.

TABLE II

| | COMPOSITION OF OIL SAMPLES | | | | | | |
|---|---|---|---|---|---|---|---|
| | °API[1] | Asphaltene (%[2]) | Water (%[2]) | Pour Point | Viscosity[3] | Sulphur[4] (%[2]) | Total Metals[4] (%[2]) |
| | Crude oil before treatment | | | | | | |
| | 12.2 | 20.0 | 18.0 | −3.0 | 68.400 | 3.2 | 1.8 |
| | After inventive treatment | | | | | | |
| 5.0% | 13.8 | 10.0 | 2.0 | −3.0 | 18.700 | 2.8 | 1.2 |
| 10.0% | 16.4 | 0.0 | 10.0 | −15.0 | 8.570 | 1.9 | 1.1 |
| 15.0% | 17.6 | 0.0 | 12.0 | −24.0 | 4.380 | 1.4 | 1.08 |
| 20.0% | 18.1 | 0.0 | 8.0 | −27.0 | 1.700 | 1.0 | 0.80 |
| | After comparative U.S. Pat. No. 4,675,120 treatment | | | | | | |
| 5.0 | 13.4 | 15.0 | 5.0 | −3.0 | 24.460 | 3.0 | 1.60 |
| 10.0 | 15.8 | 10.0 | 12.0 | −12.0 | 12.800 | 2.4 | 1.40 |
| 15.0 | 16.2 | 8.0 | 14.2 | −18.0 | 9.900 | 1.8 | 1.25 |
| 20.0 | 17.3 | 6.0 | 9.4 | −21.0 | 4.320 | 1.6 | 1.10 |

[1]API grade means American Petroleum Institute grade. It is defined as °API = 141.5/relative density of oil - 131.5. Therefore, as °API increases the specific weight of the oil sample decreases.
[2]By weight, based on the weight of the crude oil sample.
[3]Expressed in centipoise.
[4]Remaining in the crude oil sample after asphaltene reduction and after extraction with 100 ml of water.

EXAMPLE 2

The procedure of Example 1 was repeated using 300 grams of an oil-containing tar shale instead of the Venezuelan crude oil. The results obtained show that up to 91% of the total oil content is extracted by using 20% of the inventive Table I solution, whereas only 82extraction is obtained by using 20% of the comparative U.S. Patent No. 4,675,120 solution.

EXAMPLE 3

The procedure of Example 1 was repeated using 2 liters of Boscan crude oil, adding 10% by weight of the inventive Table I cold cracking solution and stirring for 10 minutes. The result is shown in Table III below.

TABLE III

| | COMPOSITION OF BOSCAN CRUDE OIL | | | |
|---|---|---|---|---|
| | °API at 60° F. | Asphaltene (%[1]) | $H_2O$ (%[1]) | Viscosity at 140° F. (centipoise) |
| Before treatment | 10.0 | 36.6 | 18.0 | 3.600 |
| After treatment | 17.6 | 4.1 | 7.2 | 114 |

[1]By weight, based on the weight of the crude oil.

In view of the foregoing teachings of the present invention, it is possible to improve the methodology applied to the recovery of oil from heavy oil and ultra-heavy crude oil deposits and from sand, shale or clay oil deposits.

This is made possible by using inexpensive and common reagents, one of which, oleic acid, is at present a by-product in oil industry of a low value. The main objective of the invention is to drastically reduce the asphaltene content of crude oil, which produces a beneficial improvement of its rheological properties. Variations in the parameters disclosed, however, are well within the skill of those in the art in view of the simple but very operative teachings of the present invention.

Thus, the invention may be embodied in other specific forms without departing from the spirit or essential characteristics thereof. The present embodiments are therefore to be considered in all respects as illustrative and non-restrictive, the scope of the invention being indicated by the appended claims rather than by the foregoing descriptions, and all changes which come within the meaning of the claims are therefore intended to be embraced therein.

I claim:

1. A method for reducing the asphaltene content of an asphaltene-containing crude oil material, comprising the steps of:

mixing an asphaltene-containing crude oil material with a cold cracking solution or emulsion, said cold cracking solution or emulsion consisting essentially of one inorganic acid, one liquid fatty acid and a light organic solvent, said one inorganic acid and said one liquid fatty acid sole acids in said cold cracking solution or emulsion, said one inorganic acid being a member selected from the group consisting of hydrochloric acid and dilute sulfuric acid; and agitating the resultant mixture of said asphaltene-containing oil material and said cold cracking solution or emulsion at a temperature between room temperature and 80° C.;

whereby asphaltene macromolecules in said asphaltene-containing oil material are depolymerized thereby reducing the asphaltene content of the aslphaltene-containing oil material; and whereby the water content of the aslphaltene-containing oil material is reduced; and whereby the water-extractability of metals and sulphur in the oil of the asphaltene-containing oil material is enhanced.

2. A method as set forth in claim 1, wherein said inorganic acid is hydrochloric acid.

3. A method as set forth in claim 1, wherein said liquid fatty acid is a member selected from the group consisting of oleic acid, linoleic acid and linolenic acid.

4. A method as set forth in claim 1, wherein the weight ratio of said inorganic acid to said liquid fatty acid in said cold cracking solution or emulsion in between about 0.1:100 to 30:100.

5. A method as set forth in claim 1, wherein said cold cracking solution or emulsion consists of said one inorganic acid, said one liquid fatty acid, said light organic solvent, an emulsifying agent and a petroleum-derived compound.

6. A method as set forth in claim 5, wherein said petroleum-derived compound is gas oil.

7. A method as set forth in claim 1, wherein said light organic solvent is selected from the group consisting of kerosene, gasoline, diesel oil, benzin and mixtures thereof.

8. A method as set forth in claim 1, wherein said cold cracking solution or emulsion consists of hydrochloric acid, oleic acid, said light organic solvent, an emulsifying agent and gas oil.

9. A method for separating oil from an inorganic component of an oil-containing tar sand, shale or clay, comprising the steps of:

a. preparing a cold cracking solution or emulsion consisting essentially of one inorganic acid, one liquid fatty acid and a light organic solvent, by slowly adding said inorganic acid to said liquid fatty acid in the presence of said light organic solvent, said one inorganic acid and said one liquid fatty acid being the sole acids in said cold cracking solution or emulsion, said one inorganic acid being a member selected from the group consisting of hydrochloric acid and dilute sulfuric acid; and b. mixing said cold cracking solution or emulsion with an oil-containing material selected from the group consisting of oil-containing tar sands, oil-containing shales and oil-containing clays, and stirring the resultant mixture vigorously at a temperature ranging from about room temperature to 80° C.

10. A method as set forth in claim 9, wherein said inorganic acid is hydrochloric acid.

11. A method as set forth in claim 9, wherein said liquid fatty acid is a member selected from the group consisting of oleic acid, linoleic acid and linolenic acid.

12. A method as set forth in claim 9, wherein the weight ratio of said inorganic acid to said liquid fatty acid in said cold cracking solution or emulsion is between about 0.1:100 to 30:100.

13. A method as set forth in claim 9, wherein said cold cracking solution or emulsion consists of said one inorganic acid, said one liquid fatty acid, said light organic solvent, an emulsifying agent and a petroleum-derived compound.

14. A method as set forth in claim 13, wherein said petroleum-derived compound is gas oil.

15. A method as set forth in claim 9, wherein said light organic solvent is selected from the group consisting of kerosene, gasoline, diesel oil, benzin and mixtures thereof.

16. A method as set forth in claim 9, wherein said cold cracking solution or emulsion consists of hydrochloric acid, oleic acid, said light organic solvent, an emulsifying agent and gas oil.

* * * * *